US008861990B2

(12) United States Patent
Watanabe et al.

(10) Patent No.: US 8,861,990 B2
(45) Date of Patent: Oct. 14, 2014

(54) IMAGE FORMING APPARATUS

(75) Inventors: Taku Watanabe, Susono (JP); Koichiro Masui, Susono (JP); Motonari Ito, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 13/344,904

(22) Filed: Jan. 6, 2012

(65) Prior Publication Data

US 2012/0177387 A1 Jul. 12, 2012

(30) Foreign Application Priority Data

Jan. 12, 2011 (JP) ..... 2011-004020
Dec. 27, 2011 (JP) ..... 2011-286817

(51) Int. Cl.
*G03G 15/00* (2006.01)
*G03G 21/00* (2006.01)

(52) U.S. Cl.
CPC ..... *G03G 21/0011* (2013.01); *G03G 15/5008* (2013.01); *G03G 15/553* (2013.01)
USPC ..... 399/26; 399/350

(58) Field of Classification Search
CPC ..... G03G 15/5008
USPC ..... 399/26, 350
See application file for complete search history.

(56) References Cited

U.S. PATENT DOCUMENTS

| | | | |
|---|---|---|---|
| 7,120,376 | B2 | 10/2006 | Saito et al. |
| 7,609,986 | B2 | 10/2009 | Sanmonji |
| 7,697,879 | B2 | 4/2010 | Watanabe et al. |
| 2002/0034401 | A1 | 3/2002 | Yanagida |

FOREIGN PATENT DOCUMENTS

| | | | |
|---|---|---|---|
| CN | 1584756 | A | 2/2005 |
| CN | 101086639 | A | 12/2007 |
| JP | S629381 | A | 1/1987 |
| JP | 8-63071 | A | 3/1996 |
| JP | 2006-91685 | A | 4/2006 |

OTHER PUBLICATIONS

Chinese Office Action dated Feb. 8, 2014, in related Chinese Patent Application No. 201210008292.4 (with English translation).

*Primary Examiner* — David Gray
*Assistant Examiner* — Andrew V Do
(74) *Attorney, Agent, or Firm* — Fitzpatrick, Cella, Harper & Scinto

(57) ABSTRACT

An image forming apparatus includes a rotatable image bearing member for bearing a developer image, a developing device for developing an electrostatic latent image on the image bearing member into the developer image and a cleaning blade. In addition, a controller executes a stop operation of the image bearing member in which the image bearing member is, after being temporarily stopped at an end of an image forming operation, rotated in the same direction as that during the image forming operation and then is rotated in a direction opposite to that during the image forming operation, and a predicting portion predicts a remaining usable lifetime of the image bearing member. In the stop operation of the image bearing member after the remaining usable lifetime is below a threshold, the controller controls an amount of rotation in the direction opposite to that during the image forming operation so as to be smaller than the amount of rotation before the remaining usable lifetime is below the threshold.

8 Claims, 9 Drawing Sheets

IMAGE FORMING APPARATUS

FIELD OF THE INVENTION AND RELATED ART

The present invention relates to an image forming apparatus, such as a copying machine or a printer in which image formation is effected by a transfer type electrophotographic process, an electrostatic recording process, and the like. Particularly, the present invention relates to the image forming apparatus in which a blade cleaning device is used as a cleaning device for an image bearing member such as an electrophotographic photosensitive member or an electrostatic recording dielectric member.

After a developer image on the image bearing member is transferred onto a recording material such as paper, the developer remains on the image bearing member in some cases such as, for example, in the image forming apparatus of an ordinary transfer type using the electrophotographic process represented by a Carlson process. As the cleaning device for removing such a transfer residual developer (hereinafter referred to as a transfer residual toner), those of various types have been known. Of these, the blade cleaning device has been widely used.

The blade cleaning device scrapes and removes the transfer residual toner from the image bearing member by bringing a cleaning blade having flexibility (rubber elasticity) as a cleaning member into contact with the image bearing member in a predetermined press-contact state to wipe the image bearing member surface. Further, the cleaning blade is generally disposed in counterdirectional contact with the image bearing member with respect to a rotational direction of the image bearing member during image formation in order to improve a cleaning efficiency.

In the blade cleaning device as described above, a sliding property (friction coefficient μ) in an image bearing member surface area is changed into a different state depending on the area. For example, in a rest state of the image forming apparatus, i.e., in an image bearing member rotation stop state, the sliding property (friction coefficient μ) in the image bearing member surface area corresponding to a cleaning blade contact area (nip area) of the photosensitive drum is liable to be changed into a state different from that in another image bearing member surface area. Further, it is known that this causes an occurrence of a stripe on an image or image blur (density fluctuation or the like) during subsequent image formation.

It has been known that the change in sliding property in the image bearing member surface area corresponding to the cleaning blade contact area of the image bearing member is attributable to the following factor. That is, the change in sliding property is caused due to agglomeration of a residue, such as a fine powder toner or an external additive with a small particle size remaining in the cleaning blade contact area, by being pressed against the image bearing member surface with a press-contact force of the cleaning blade. Generally, the friction coefficient μ in the image bearing member surface area corresponding to the cleaning blade contact area of the image bearing member varies at a level lower than that of the friction coefficient μ in another image bearing member surface area.

In such a state, a friction force between the image bearing member and the cleaning blade is changed when the image forming apparatus is re-driven to rotate the image bearing member and the image bearing member surface area corresponding to the cleaning blade contact area in which the friction efficiency is decreased is returned to the contact portion between the image bearing member and the cleaning blade. The rotational speed of the image bearing member is changed to a higher value at the moment when the image bearing member surface area passes through the contact portion between the image bearing member and the cleaning blade. At this time, the stripe or the image blur (the density fluctuation or the like) with a period of the image bearing member occurs at a portion where the image has been formed on the image bearing member and at a portion from which the image has been transferred onto the recording material.

In order to essentially solve the above problem, it is most reliable that the cleaning blade is retracted from the image bearing member surface when the image forming apparatus is in the rest state. However, in this case, a retracting mechanism is costly and in addition, it is difficult to ensure accuracy of the contact state when the cleaning blade is contacted again in after being retracted. For this reason, the retraction of the cleaning blade leads to defective cleaning and by extension to deterioration of an image quality. Further, when the cleaning blade contacts the image bearing member again, there arises such a problem that the cleaning blade is required to contact again an image bearing member area, which has been cleaned before the retraction, in order not to create an uncleaned area.

Therefore, in Japanese Laid-Open Patent Application (JP-A) Hei 8-63071, a method in which an agglomerated toner stagnating at an edge portion of the cleaning blade between the image bearing member and the cleaning blade is removed from the edge portion of the cleaning blade by rotating the image bearing member in the direction opposite to that during the image formation (hereinafter referred to as a predetermined) has been proposed.

Further, in JP-A 2006-91685, the method of JP-A Hei 8-63071 is further developed and specifically, an operation in which, during the rest of the image bearing member, the image bearing member is subjected to rotational movement intermittently plural times in the same direction as that during the image formation and therefore is subjected to the predetermined is performed. As a result, the fine powder toner and the external additive which stagnate at the cleaning blade edge portion are dispersed, so that degrees of the stripe and the image blur due to rotational load fluctuation of the image bearing member are reduced with reliability. Such a method has also been proposed.

In the case where a control sequence for performing the reverse rotation during the rest of the image bearing member disclosed in JP-A Hei 8-63071 and JP-A 2006-91685, when a photosensitive drum including a thin photosensitive layer is used as the image bearing member, there arose the following problem. In order to suppress the stripe and the image blur due to the rotational load fluctuation of the image bearing member, the reverse rotation is performed. In this case, in an area in which the reverse rotation is performed, compared with an area in which the reverse rotation is not performed, an abrasion speed of the photosensitive layer of the image bearing member surface (i.e., a degree of progress of abrasion (wearing) of the photosensitive layer) is increased (FIG. 11). This is because an abrasion amount of the photosensitive layer varies depending on the presence or absence of the toner or residue which achieves lubricity when the cleaning blade contacts and slides on the image bearing member surface. The cleaning blade removes the toner and the residue at an upstream surface thereof with respect to a rotational direction of the image bearing member during rotation of the image bearing member for image formation (hereinafter referred to as a normal rotation). For this reason, the toner and the residual are present between the photosensitive layer surface and the upstream surface of the cleaning blade with respect to the rotational direction of the image bearing member. By a lubricating action of the toner and the residue, in the case where the image bearing member is subjected to the normal rotation, the abrasion amount of the photosensitive layer is suppressed. On the other hand, during the reverse rotation, a downstream surface of the cleaning blade with respect to the rotational direction of the image bearing member contacts the photosensitive layer but there are no toner and residue between the downstream surface of the cleaning blade and the photosensitive layer surface, so that the cleaning blade is in a state in which it directly contacts and slides on the photosensitive layer. As a result, compared with during the normal rotation, the abrasion amount of the photosensitive layer is increased. Thus, a layer thickness of the photosensitive layer is different between the area in which the reverse rotation is performed and the area in which the reverse rotation is not performed.

In an area in which the layer thickness of the photosensitive layer is small, compared with an area in which the layer thickness is large, electric capacity of the image bearing member is increased and therefore even in the case where a dark-portion potential at the image bearing member surface is the same, an amount of electrons held at the surface is increased. For that reason, when a latent image is intended to be formed at the same exposure light quantity, an amount of generated positive electric charges is constant and therefore a light-portion potential becomes high. The electric capacity of the image bearing member is inversely proportional to the layer thickness of the photosensitive layer and therefore an amount of increase of the light-portion potential becomes large with a decrease of the layer thickness. Thus, when the layer thickness of the photosensitive layer is decreased, a difference in layer thickness of the photosensitive layer appears conspicuously as density non-uniformity on the image (hereinafter referred to as a stepwise non-uniform density image). Therefore, this problem is conspicuous in the latter half of a lifetime of the image bearing member in which the layer thickness of the photosensitive layer becomes thin.

SUMMARY OF THE INVENTION

A principal object of the present invention is to provide an image forming apparatus capable of suppressing an non-uniform abrasion image, such as a vertical stripe image or a stepwise non-uniform density image due to abrasion of a photosensitive layer, generated in the latter half of a lifetime of an image bearing member while suppressing a stripe image and image blur due to rotational load fluctuation of the image bearing member.

According to an aspect of the present invention, there is provided an image forming apparatus comprising: an image bearing member for bearing a developer image; driving means for rotationally driving the image bearing member; a developing device for developing an electrostatic latent image on the image bearing member into the developer image; a cleaning blade, slidably contacting the image bearing member which is rotated, for removing from the image bearing member a developer remaining on the image bearing member after transfer of the developer image; control means capable of executing a stop operation of the image bearing member in which the image bearing member is, after being temporarily stopped at the time of an end of an image forming operation, rotated in the same direction as that during the image forming operation and then is rotated in a direction opposite to that during the image forming operation; and predicting means for predicting a remaining usable lifetime of the image bearing member, wherein in the stop operation of the image bearing member after the remaining usable lifetime is below a threshold, the control means controls an amount of rotation in the direction opposite to that during the image forming operation so as to be smaller than the amount of rotation before the remaining usable lifetime is below the threshold.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments for carrying out the present invention will be exemplary and specifically described based on Embodiments with reference to the drawings. However, dimensions, materials, shapes, relative arrangements and the like of constituent elements described in the following embodiments are appropriately changed depending on constitutions or various conditions of devices (apparatuses) to which the present invention is applied. That is, the scope of the present invention is not limited to the following embodiments.

Embodiment 1

Figure 2:
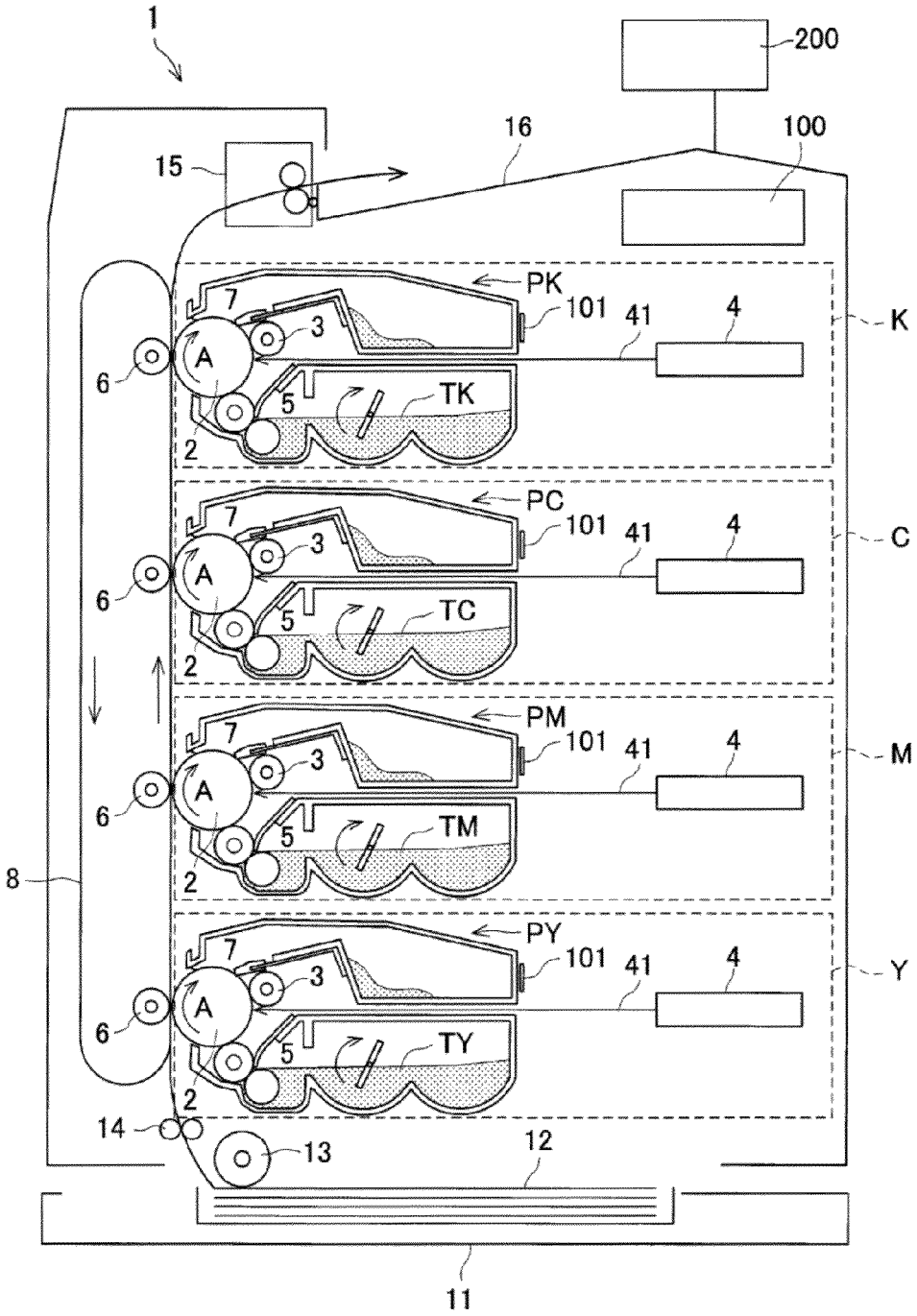
FIG. 2 is a schematic view of an image forming apparatus in Embodiment 1 of the present invention.

FIG. 2 is a schematic illustration of an image forming apparatus in this embodiment. This image forming apparatus 1 is a four color-based full-color image forming apparatus (multi-color image forming apparatus) which uses an electrophotographic process and has a vertical tandem constitution (in-line constitution).

Inside the image forming apparatus 1, first to fourth (four) image forming stations Y, M, C and K for forming toner images of yellow, magenta, cyan and black, respectively, are arranged in parallel from a lower side to an upper side (the vertical tandem constitution).

The respective image forming stations Y, M, C and K are the same electrophotographic process mechanism except that the colors of the toner images to be formed are different from each other. That is, each of the image forming stations includes a drum-like electrophotographic photosensitive member 2 as the image bearing member (hereinafter referred to as a photosensitive drum or developer), a charging roller 3, a laser scanner 4, a developing device 5, a transfer roller 6, a cleaning device 7, and the like. The charging roller 3 uniformly charges, as a charging device, a surface of the developer 2 in contact with the photosensitive drum 2. The laser scanner 4 irradiates, as an exposure device, the charged surface of the photosensitive drum 2 with light depending on image information to form an electrostatic latent image. The developing device 5 develops the electrostatic latent image on the surface of the photosensitive drum 2 with a toner as a developer. The transfer roller 6 transfers, as a transfer device, the developed toner image (developer image) onto a recording medium (recording material) such as paper. The cleaning device 7 removes transfer residual toner remaining on the surface of the photosensitive drum 2 after the toner image transfer. The toners accommodated in the developing devices 5 of the image forming stations Y, M, C and K are yellow toner TY, magenta toner TM, cyan toner TC and black toner TK, respectively.

Figure 3:
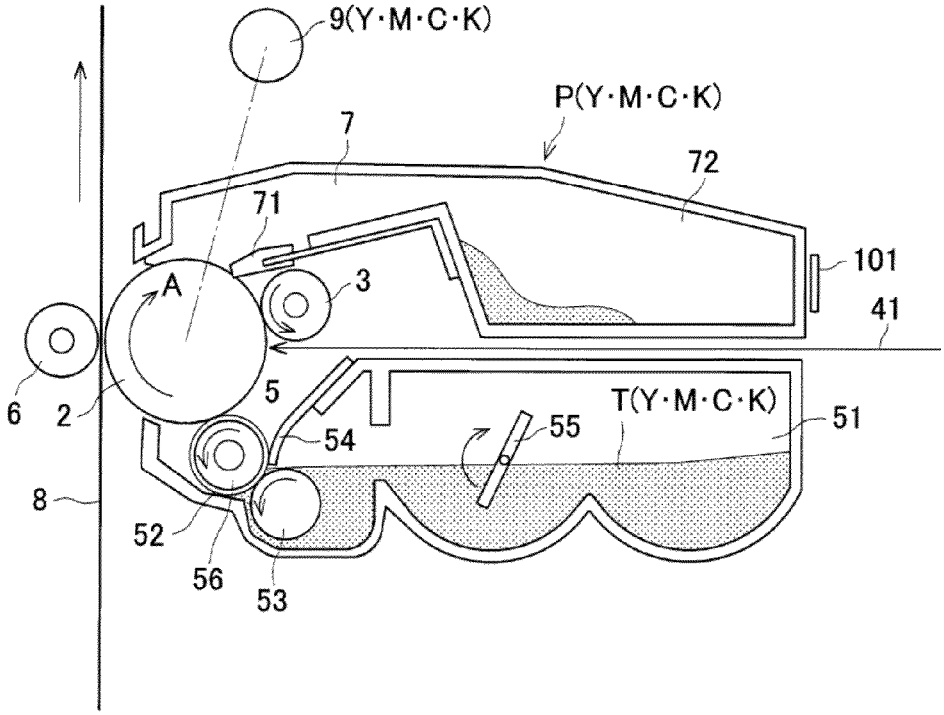
FIG. 3 is an enlarged schematic view of a process cartridge in Embodiment 1 of the present invention.

In this embodiment, in each of the image forming stations Y, C, M and K, four process devices of the photosensitive drum 2, the charging roller 3, the developing device 5 and the cleaning device 7 are collectively assembled into each of process cartridges PY, PM, PC and PK which are detachably mountable to a main assembly of the image forming apparatus 1. Each of the process cartridges PY, PM, PC and PK is provided with a non-volatile memory 101 which is capable of communicating with a control means portion 100 (CPU) via a contact (not shown) to the main assembly of the image forming apparatus 1. Incidentally, the control means portion 100 and the non-volatile memory 101 constitutes a predicting means 110 in combination. FIG. 3 is an enlarged view of the process cartridge P (Y, M, C, K) portion.

An electrostatic conveyer belt 8 is an endless belt for carrying and conveying a transfer material (transfer-receiving material) 12 which is circularly moved. The electrostatic conveyer belt 8 is vertically provided, over the while image forming stations Y, M, C and K at their photosensitive drum 2 sides, by being stretched and adjusted by a plurality of supporting rollers (not shown). Further, in each of the image forming stations Y, M, C and K, the transfer roller 6 is press-contacted to the electrostatic belt 8 toward the photosensitive drum 2. An opposite contact portion (contact portion) between each photosensitive drum 2 and the electrostatic conveyer belt 8 is a transfer portion.

A sheet feeding cassette 11 (sheet feeding portion) is provided at a lower portion of the main assembly of the image forming apparatus 1 and in which the transfer material 12 as the recording material (media) is stacked and accommodated. On the basis of a print demanding signal, a sheet feeding roller is driven, so that the transfer material 12 is separated and fed one by one from the sheet feeding cassette 11.

The transfer material 12 is once stopped by a registration roller 14 and then is conveyed in synchronism with image forming timing of the toner image in each of the image forming stations Y, M, C and K.

Figure 4:
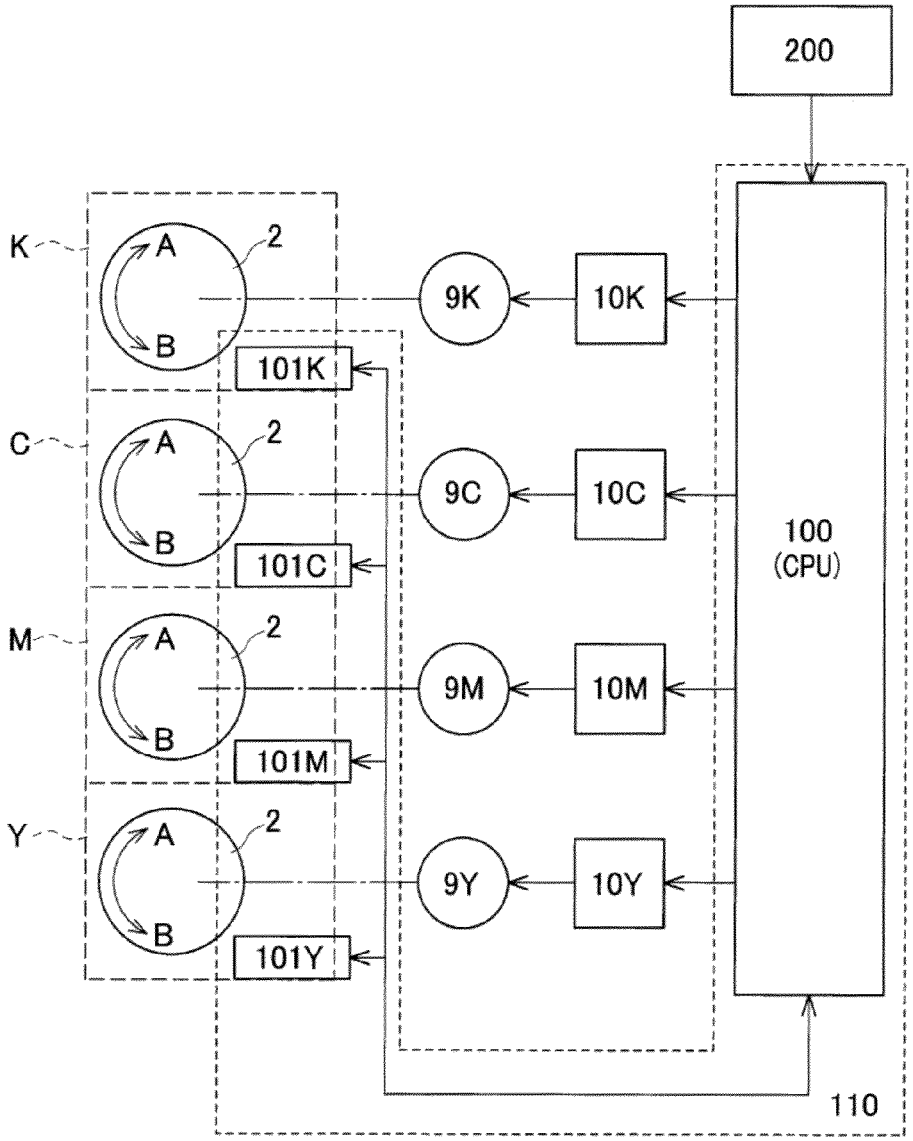
FIG. 4 is a block diagram of a rotational drive control system for a photosensitive drum in Embodiment 1 of the present invention.

In the main assembly of the image forming apparatus 1, the photosensitive drums 2 of the image forming stations Y, M, C and K are driven by motors 9Y, 9M, 9C and 9K as a driving means independently for each of the image forming stations Y, M, C and K as shown in FIG. 4.

FIG. 4 is a block diagram of a rotational drive control system for the photosensitive drum 2 in this embodiment. The control means portion 100 is a CPU for managing a sequence control of an image forming operation of the entire image forming apparatus 1. The above-described motors 9Y, 9M, 9C and 9K are independently subjected to execution of normal rotation drive control, reverse rotation drive control and stop control via drivers 10Y, 10M, 10C and 10K, respectively. By subjecting each motor to the normal rotation drive control, each photosensitive drum 2 is subjected to normal rotation drive in an arrow A direction which is the clockwise direction. Further, by subjecting each motor to the reverse rotation drive control, each photosensitive drum 2 is subjected to reverse rotation drive in an arrow B direction which is the counter-clockwise direction. By subjecting each motor to the stop control, each photosensitive drum 2 is placed in a rotation stop state.

The image forming apparatus 1 is connected to a host 200 such as a personal computer and receives the print demanding signal from the host 200 to receive image data, which are developed into color data of yellow, magenta, cyan and black.

Then, in synchronism with predetermined print timing in the image forming sequence, each of the photosensitive drums 2 of the image forming stations Y, M, C and K is subjected to the normal rotation drive at a predetermined speed. Then, the laser scanner 4 is driven and simultaneously the electrostatic conveyer belt is rotationally driven.

Each of the photosensitive drums 2 of the image forming stations Y, M, C and K is uniformly charged to a predetermined potential by applying a predetermined charging bias to the charging roller 3 rotated by the rotation of the photosensitive drum 2 in contact with the developer 2 during its rotation. In this embodiment, each photosensitive drum 2 is a rigid member constituted by successively applying, onto an outer peripheral surface of an aluminum cylinder of 30 mm in diameter, a resistance layer, an undercoat layer, a charge-generating layer and a charge-transporting layer by dipping. A peripheral speed of the photosensitive drum 2 is 94 mm/sec. In this embodiment, the charge-transporting layer as a surface layer of the developer 2 is described as a photosensitive layer.

Thereafter, the uniformly charged surface of the photosensitive drum 2 is irradiated with laser light 41 corresponding to an image signal for each color, so that the electrostatic latent image based on the image signal is formed. That is, in the first image forming station Y, laser exposure based on yellow image data is effected to form the electrostatic latent image. In the second image forming station M, laser exposure based on magenta image data is effected to form the electrostatic latent image. In the third image forming station C, laser exposure based on cyan image data is effected to form the electrostatic latent image. In the fourth image forming station K, laser exposure based on black image data is effected to form the electrostatic latent image. Each of the electrostatic latent image is developed by the developing device 5 of each of the image forming stations Y, M, C and K, so that the toner image is formed.

As a result, on the surfaces of the photosensitive drums 2 of the first to fourth image forming stations Y, M, C and K, yellow toner image, a magenta toner image, a cyan toner image and a black toner image are formed with predetermined sequence control timing.

The developing device 5 accommodates the toner T (Y, M, C, K) corresponding to each color in a developing container 51. Further, the developing device 5 is provided with a developing roller 52, a feeding roller 53, a developing blade 54 and a toner feeding member 55. The developing roller 52 is provided opposite to the developer 2 and as a developer carrying member, develops the electrostatic latent image on the developer 2 with the toner to visualize the electrostatic latent image. The feeding roller feeds the toner to the developing roller 52. The developing blade 54 regulates a toner layer thickness on the developing roller 52. The toner feeding member feeds the toner to the feeding roller 53.

Incidentally, the developing device 5 is provided contactable to and separable from the photosensitive drum 2. The developing device 5 contacts the photosensitive drum 2 when the image forming operation is started and is separated (spaced) from the photosensitive drum 2 when the image forming operation is ended.

Here, the developing roller 52 includes a base layer of silicone rubber disposed on a core metal of 8 mm in diameter to have a diameter of 16 mm. A surface layer is formed by applying a mixture liquid of urethane resin material and roughening particles. A hardness of the developing roller 52 was 34 degrees measured by a hardness meter ("MD−1", mfd. by Kobunshi Keiki Co., Ltd.) and was 58 degrees in terms of Asker C hardness measured by a hardness meter (mfd. by Kobunshi Keiki Co., Ltd.). The developing roller 52 is regulated by a roller 56 so as to provide a penetration depth of 40 μm with respect to the photosensitive drum 2. The peripheral speed of the developing roller 52 was 141 mm/sec.

The developing blade 54 was prepared by coating the surface of a substrate of phosphor bronze with polyamide elastomer ("DIAMID E40" (trade name)). A contact pressure to the developing roller 52 was 50 g/cm and the developing blade 54 was disposed so that its edge portion contacted the developing roller 52.

The feeding roller 53 was prepared by coating a core metal of 6 mm in diameter with urethane foam so as to have a diameter of 16 mm. The feeding roller 53 was disposed so as to enter the developing roller 52 in a penetration depth of 1.25 mm and was rotated at a speed of 127 mm/sec.

On the other hand, with predetermined sequence control timing, the transfer material 12 fed from the sheet feeding cassette 11 to the electrostatic conveyer belt 8 is conveyed from below to above while being held by the electrostatic conveyer belt 8. Then, at the transfer portions of the first to fourth image forming stations Y, M, C and K, onto the transfer material 12, the toner images of yellow, magenta, cyan and black are successively transferred superposedly, respectively. That is, a predetermined transfer bias is applied from the transfer 7 of each of the image forming stations Y, M, C and K via the electrostatic conveyer belt 8, so that the toner images are successively transferred from the photosensitive drums 2 onto the transfer material 12.

The transfer material 12 onto which the four color toner images are superposedly transferred is separated from the electrostatic conveyer belt at an upper end side of the electrostatic conveyer belt 8 and is conveyed into a fixing device 15. The fixing device 15 fixes the toner images transferred on the transfer material 12. The transfer material 12 on which the toner images are transferred is subjected to heat and pressure when it passes through the fixing device 15. As a result, the toner image constituted by a plurality of color component toner images is permanently fixed on the surface of the transfer material 12. Then, the transfer material 12 which has passed through the fixing device 15 is discharged, as a four color-based full-color image formed product, onto a sheet discharge tray 16 at an upper surface of the main assembly of the image forming apparatus 1 in a state in which an image surface is directed upward.

Further, in each of the image forming stations, Y, M, C and K, the surface of the photosensitive drum 2 after the transfer of the toner image onto the transfer material 12 is subjected to removal of the transfer residual toner by the cleaning device 7 and then prepares for subsequent image formation. The cleaning device 7 is constituted by a cleaning blade 71, as a cleaning member, having flexibility (rubber elasticity) and a residual toner container 72 in which the transfer residual toner scraped by the cleaning blade 71 is stored. The cleaning blade 71 is contacted and disposed counterdirectionally to the photosensitive drum 2 with respect to a normal rotational direction which is a rotational direction of the photosensitive drum 2 during the image formation. The cleaning blade 71 is constituted so as to be slidable on the rotating surface of the photosensitive drum 2 and as a result, the toner remaining on the photosensitive drum 2 is wiped.

Incidentally, in this embodiment, a contact pressure of the cleaning blade 71 with respect to the photosensitive drum 2 is 80-90 gf/cm, and the cleaning blade 71 is formed with an urethane rubber having a hardness of 70±2 degrees as measured by a Wallace hardness meter.

The image forming apparatus 1 receives, after completion of the image forming operation, a subsequent print demanding signal (subsequent print job) from the host 200 such as the personal computer and then performs the subsequent image forming operation. When there is no print demanding signal, the image forming apparatus 1 executes a stop control sequence of the photosensitive drum 2.

(Photosensitive Drum Stop Control Sequence)

After the image forming operation is ended, when the photosensitive drum 2 is stopped, a photosensitive drum stop control sequence is executed. This photosensitive drum stop control sequence first temporarily stops, after the completion of the image forming operation, the photosensitive drum 2 and then intermittently rotationally moves the photosensitive drum 2 plural times in the same direction as that during the image forming operation (herein referred to as the normal rotation). Thereafter, the photosensitive drum 2 is rotationally moved in the direction opposite to that during the image formation (herein referred to as the reverse rotation) and then is completely stopped.

The image forming apparatus 1 in this embodiment is constituted so as to be capable of executing such a stop operation of the photosensitive drum 2 when each image forming operation is ended.

(Specific Control Method in Constitution in Embodiment 1)

In this embodiment, the photosensitive drum stop control sequence was such that the intermittent normal rotation performed plural times after the rotation of the photosensitive drum was temporarily stopped was performed five times by movement of 1 mm per 5 sec, and the reverse rotation was performed one time by movement of 5 mm in the reverse rotational direction after a lapse of 5 sec from the stop of the intermittent normal rotation. Further, the normal rotation and the reverse rotation in the photosensitive drum stop control sequence are controlled depending on the layer thickness of the photosensitive layer of the photosensitive drum 2. More specifically, the photosensitive layer thickness is predicted from use (operation) information of the photosensitive drum 2 such as a rotation time described later, so that a remaining amount (remaining usable lifetime) (%) of the photosensitive drum 2 indicating a degree of how long the develop 2 is usable (how much abrasion of the photosensitive layer proceeds) is predicted. This prediction is made by calculating the remaining amount (%) of the photosensitive drum 2 on the basis of the use information of the photosensitive drum 2. Then, in the stop operation of the photosensitive drum, at the time when the image forming operation is ended, performed after a predicted value is below a predetermined value (threshold), the reverse rotation is not performed.

[1. Calculation Method of Predicted Value of Remaining Amount (%) of Photosensitive Drum 2]

A calculation method of the predicted value of the remaining amount (%) of the photosensitive drum 2 (hereinafter referred to as D (%)) will be described.

The abrasion amount of the photosensitive drum 2 is different in the following three cases (i), (ii) and (iii).

(i) Case where only the photosensitive drum 2 is rotated.

(ii) Case where the photosensitive drum 2 is rotated and is charged.

(iii) Case where the photosensitive drum 2 is rotated and is charged, and contacts the photosensitive drum 2.

Therefore, when the following items are known, the remaining amount D (%) of the photosensitive drum 2 can be predicted.

(1) Abrasion amount C of photosensitive layer per unit time (μm/sec) in (iii).

(2) Ratios $K_{(i)}$ and $K_{(ii)}$ of (ii) when (iii) is 1.

(3) Times $T_{(i)}$, $T_{(ii)}$ and $T_{(iii)}$ (sec) of (i), (ii) and (iii), respectively, during image formation.

(4) Usable layer thickness B (μm) of photosensitive layer.

(5) Current remaining layer thickness E (μm) f photosensitive layer.

(1), (2), (4) and (5) are stored in advance in the non-volatile memory 101 of each process cartridge. (3) is calculated by the CPU 100.

From the above items, an abrasion amount of the photosensitive layer by the image formation is calculated by the following equation (1).

$$A=C\times(K_{(i)}\times T_{(i)}+K_{(ii)}\times T_{(ii)}+T_{(iii)} \quad (1)$$

From the abrasion amount A (μm) of the photosensitive layer by the image formation, the usable layer thickness B (μm) of the photosensitive layer and the current remaining layer thickness E (μm) of the photosensitive layer, the remaining amount D (%) of the photosensitive drum 2 is calculated by the following equation (2).

$$D=[(E-A)/B]\times 100 \quad (2)$$

Incidentally, after the calculation is ended, the current remaining layer thickness E (μm) of the photosensitive layer in the non-volatile memory 101 is rewritten into a calculation result E' (μm) by the following equation (3), and E' (μm) is treated as E (μm) during subsequent calculation.

$$E'=E-A \quad (3)$$

[2. Specific Control Flow]

Figure 1:
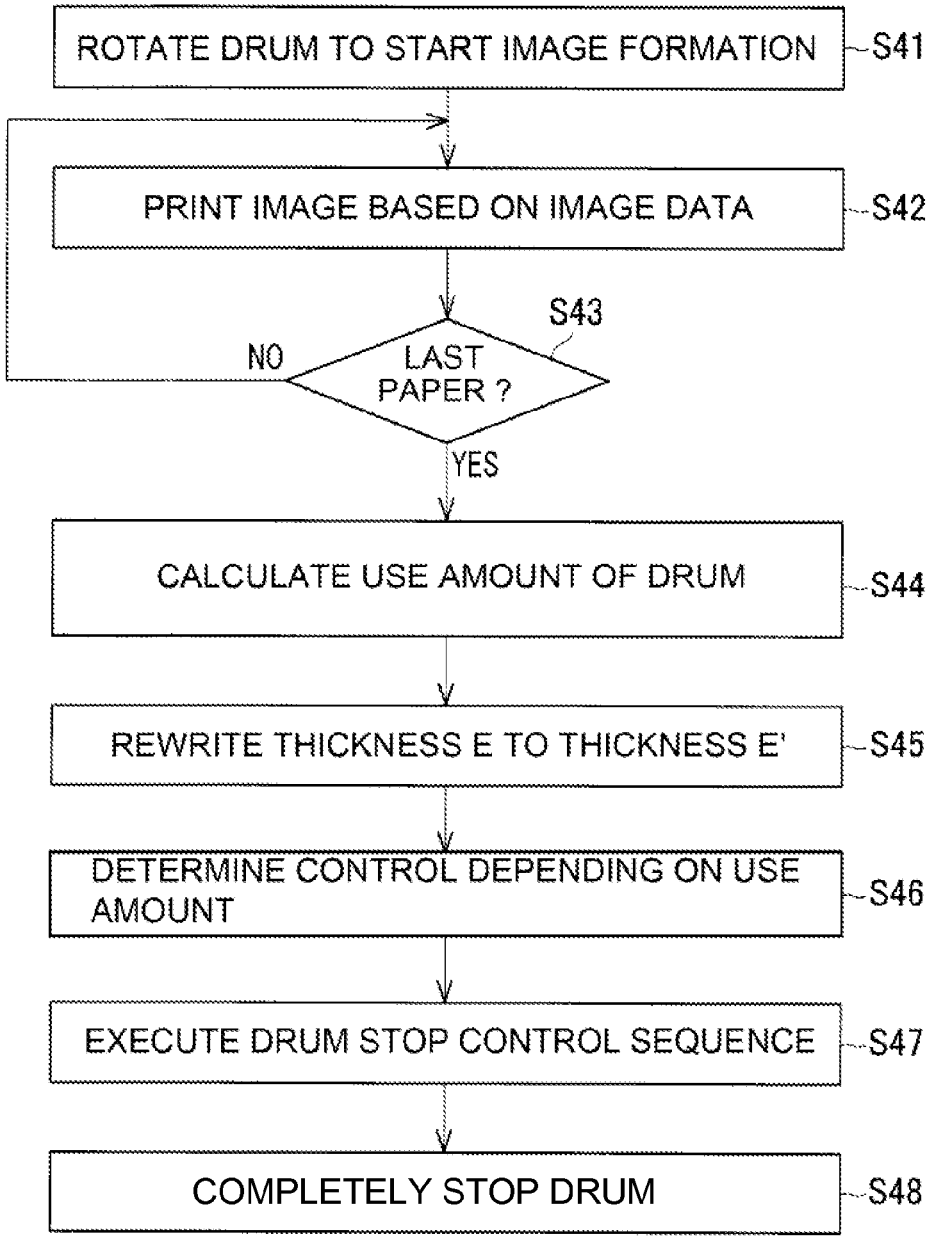
FIG. 1 is a flow chart of a photosensitive drum stop control sequence in Embodiment 1 of the present invention.

Specific control flow in this embodiment will be described with reference to FIG. 1.

First, the image forming apparatus 1 receives the print demanding signal from the host 200 and rotates the photosensitive drum 2 to start the image forming operation (S41). From the timing, measurement of each of the times $T_{(i)}$, $T_{(I)}$ and $T_{(aye)}$ (sec) of (i), (ii) and (iii), respectively during the image formation is started. The image is printed (formed) on the basis of the image data (S42). Whether or not the conveyed transfer material 12 is a final transfer material (last paper) or not is checked (S43). When the conveyed transfer material 12 is not the final transfer material 12, the operation is returned to S42. In the case where the conveyed transfer material 12 is judged as being the final transfer material 12, the times $T_{(i)}$, $T_{(ii)}$ and $T_{(iii)}$ (sec) until the rotation stop of the photosensitive drum 2 are calculated, and the predicted value of the remaining amount D (%) of the photosensitive drum 2 is calculated by the above equation (2) (S44). The current remaining layer thickness E of the photosensitive layer stored in the non-volatile memory 101 is rewritten into the remaining layer thickness E' of the photosensitive layer after the calculation (S45). Depending on the calculated remaining amount (%) of the photosensitive drum, a control method of the intermittent normal rotation and the reverse rotation is determined (S46). In this embodiment, a threshold of the remaining amount D (%) was 55%, and the reverse rotation was performed by 5 mm when the remaining amount D (%) of the photosensitive drum is 100% to 55% and was not performed when the remaining amount D (%) is 54% to 0%. The photosensitive drum stop control sequence depending on the control method in S46 is executed (S47). The photosensitive drum is completely stopped (S48).

(Specific Control Method in Constitution in Comparative Embodiment 1)

In Comparative Embodiment 1, irrespective of the remaining amount D (remaining lifetime) of the photosensitive drum described in [2. Specific control flow], the reverse rotation is carried out. That is, in S46, the reverse rotation was always performed by 5 mm.

(Result of Study of Abrasion Non-Uniformity)

Figure 5:
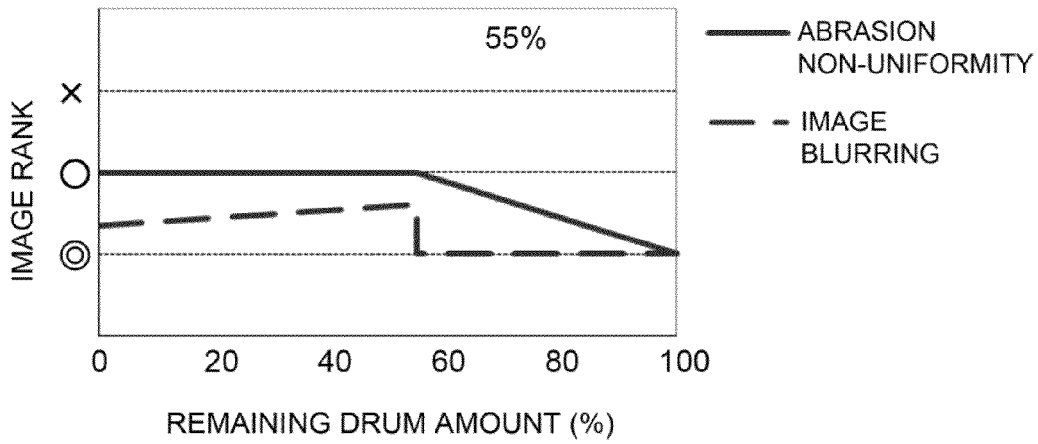
FIG. 5 is a graph showing relationships between a remaining amount (%) of the photosensitive drum and abrasion non-uniformity and between the remaining amount (%) and image blur in Embodiment 1.
Figure 6:
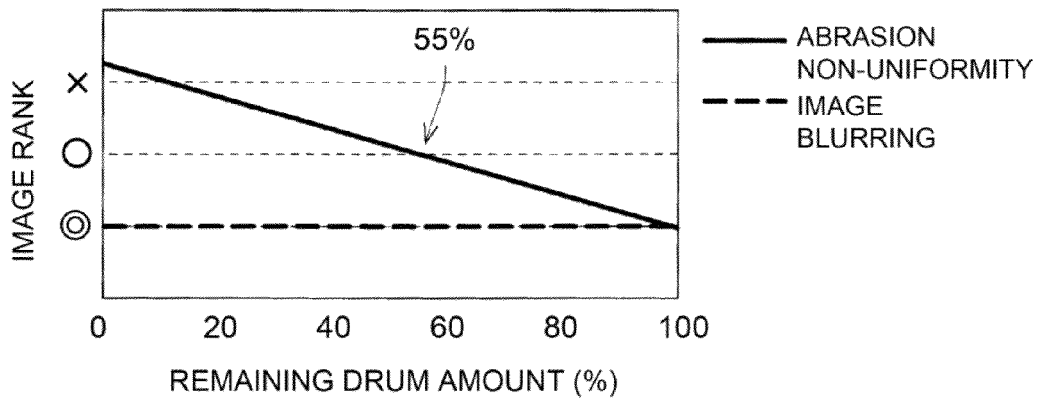
FIG. 6 is a graph showing relationships between the remaining amount (%) of the photosensitive drum and the abrasion non-uniformity and between the remaining amount (%) and the image blur in Comparative Embodiment 1.

FIG. 5 is progression of the abrasion non-uniformity and the image blur with respect to the remaining amount D of the photosensitive drum in Embodiment 1. FIG. 6 is progression of the abrasion non-uniformity and the image blur with respect to the remaining amount D of the photosensitive drum in Comparative Embodiment. In each figure, the ordinate represents an image rank, which was evaluated as follows.

◎: No occurrence of abrasion non-uniformity or image blur at all.

○: Slight abrasion non-uniformity or image blur when observed at a close position (within a tolerable range as the image: not the image defect).

x: Observed as abrasion non-uniformity or image blur (out of the tolerable range: the image defect).

In FIG. 5, when the remaining amount D of the photosensitive drum is 100% to 55%, the abrasion non-uniformity level was from "◎" to "○". Further, the image blur level was "◎" throughout the entire remaining amount range. Throughout the remaining amount D of the photosensitive drum from 54% to 0%, the abrasion non-uniformity level was "◎". Further, the image blur level was changed from "◎" to "○" from the time when the reverse rotation was not performed, and was improved when the remaining amount D approaches 0%. The abrasion non-uniformity is deteriorated by performing the reverse rotation. At 54% or more, the reverse rotation is not performed and therefore the degree of the image blur is not changed on the image. The image blur level is "◎" by performing the reverse rotation until the remaining amount of 55% but is between "◎" and "○" when the reverse rotation is stopped. The reason why the image blur level is improved in the range from 54% to 0% is that the residue, such as the fine powder toner or external additive with the small particle size, causing the image blur is generated in a large amount in the front half of the lifetime of the process cartridge and is decreased in the latter half of the lifetime. The fine powder toner is, in an ordinary system such that the developer is supplied to the developing roller by a supplying roller and is regulated by a metal blade, regulated with respect to that of a large particle size during the regulation and thus is selectively subjected to the development from that of a small particle size and therefore is used in the large amount in the front half of the lifetime and is decreased in the latter half of the lifetime. Further, with respect to the residue such as the external additive, in the front half of the lifetime, the external additive liberated at an initial stage or the external additive externally added to the toner is large in amount but in the latter half of the lifetime, the toner is deteriorated and thus the amount of the external additive is decreased.

In FIG. 6, in the case where the reverse rotation was performed irrespective of the remaining amount D of the photosensitive drum, in an area in which the remaining lifetime of the photosensitive drum was small, the abrasion non-uniformity level was "x". This is because a difference in photosensitive layer thickness between an area in which the reverse rotation is performed and an area in which the reverse rotation is not performed is increased and because the photosensitive layer thickness itself is decreased and therefore the layer thickness difference is conspicuous on the image.

Here, when the fine powder toner and external additive t which have passed through the cleaning blade 71 reach the contact position of the charging roller 3 as the contact charging means to the photosensitive drum 2, these contaminate the charging roller 3, so that there is a possibility that the image defect such as stripe or fog due to improper charging is caused. Therefore, it is desirable that a total amount of movement of the photosensitive drum 2 subjected to the intermittent normal rotation is smaller than a distance from the contact portion of the cleaning blade 71 to the charging roller contact portion on the photosensitive drum 2.

In this embodiment, the distance from the contact portion of the cleaning blade 71 to the contact portion of the charging roller 3 with respect to the photosensitive drum 2 was 12.56 mm, and the amount of movement per (one) intermittent normal rotation was 1 mm. Therefore, the total movement amount of the photosensitive drum 2 by the intermittent normal rotation is 5 mm (=1 mm×5 times) or 1 mm (=1 mm×1 time) and therefore the fine powder toner and external additive t which have passed through the cleaning blade 71 do not contaminate the charging roller 3.

Further, in this embodiment, the amount of movement per intermittent normal rotation is always 1 mm. However, the movement amount is not always required to be 1 mm but may also be changed for each intermittent normal rotation.

Further, in this embodiment, the amount of the reverse rotation is 5 mm but may also be within a range in which the amount is larger than the total movement amount of the photosensitive drum 2 during the intermittent normal rotation and in which the residual toner does not reach the contact position (transfer portion) with the transfer means. That is, the reverse rotation amount is selectable within a distance from the contact portion (contact position) of the cleaning blade 71 to the transfer portion (transfer position). In this embodiment, the distance from the cleaning blade 71 (contact portion) to the transfer portion (the contact portion between the photosensitive drum 2 and the electrostatic conveyer belt 8) is 29.85 mm.

Further, the photosensitive drum stop control sequence in this embodiment is applicable to all of the photosensitive drums 2 of the first to fourth image forming stations Y, M, C and K disposed in the image forming apparatus 1 of the tandem type. Further, in this embodiment, the image forming apparatus 1 of the tandem type in which each of the plurality of photosensitive drums 2 is independently provided with the drive means is used. In such a case, the photosensitive drum stop control sequence control may also be effected separately depending on the remaining amount D (%) of each of the photosensitive drums 2 in the image forming stations Y, M, C and K. That is, also various parameters (the normal rotation movement amount, waiting time, the reverse rotation movement amount) of the photosensitive drum stop control sequence are independently controlled. As a result, an optimum operation is performed in each of the image forming stations Y, M, C and K, so that it becomes possible to effectively suppress occurrences of periodical stripes and vertical stripes on the photosensitive drums.

Further, the rotational drive of each image bearing member in the image forming apparatus 1 of the tandem type can also be of a single (one) motor system in which the plurality of the image bearing members are driven by a single motor (driving means). It is also possible to provide an image forming apparatus having a horizontal tandem constitution in which the plurality of image forming stations (image bearing members) are arranged in the horizontal direction.

Further, the photosensitive drum stop control sequence according to the present invention is applicable to not only the four color-based full-color image forming apparatus as in this embodiment but also a single color image forming apparatus.

As described above, the image forming apparatus 1 in this embodiment is characterized by the constitution in which the reverse rotation amount in the control sequence during the stop of the photosensitive drum is decreased depending on the layer thickness of the photosensitive layer of the developer 2, specifically with a decrease of the layer thickness (with a degree of progress of the abrasion of the photosensitive layer). More specifically, the rotation amount of the reverse rotation after the remaining lifetime of the photosensitive drum 2 is below the predetermined threshold is made zero (i.e., the reverse rotation is not performed). The threshold of switching of the rotation amount of the reverse rotation is, as shown in FIG. 5, appropriately set depending on apparatus constitution and specifications from the viewpoint that good image formation can be effected until the remaining lifeamount of the photosensitive drum 2 becomes zero (until the lifetime is ended), or the like.

Embodiment 2

Figure 7:
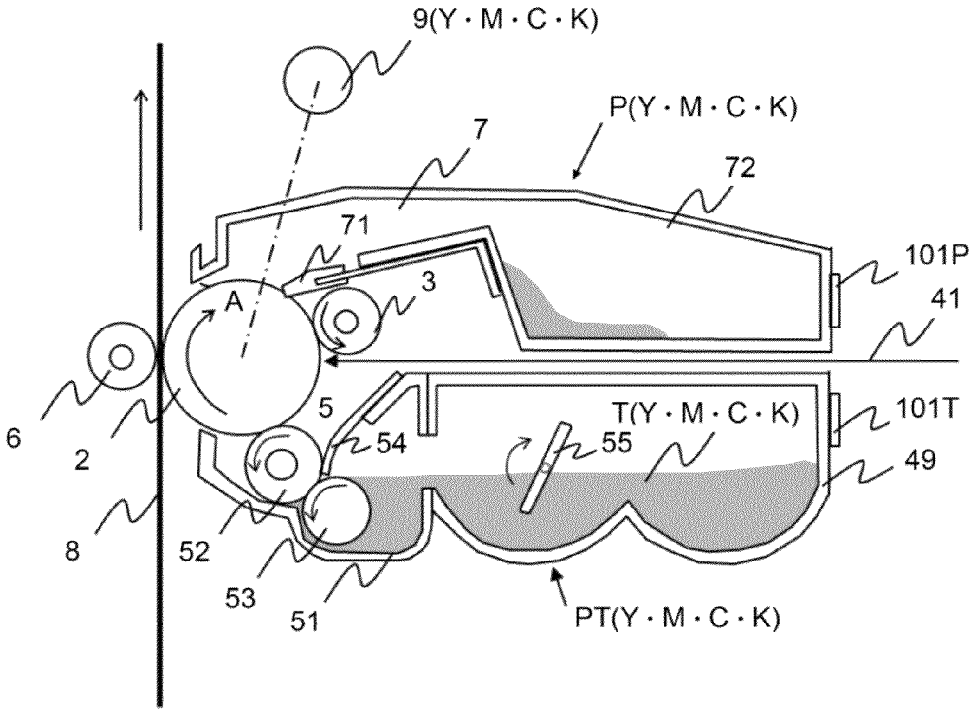
FIG. 7 is an enlarged schematic view of a process cartridge and a toner cartridge in Embodiment 2.

A constitution in this embodiment will be described with reference to FIG. 7. FIG. 7 is an enlarged schematic view of the process cartridge an the toner cartridge.

This embodiment is characterized in that each of a P cartridge and a T cartridge, which are described below, in each of the image forming stations Y, M, C and K is provided detachably mountable to the main assembly of the image forming apparatus 1. The perform cartridge is the process cartridge (PY, PM, PC, PK) which is prepared by collectively assembling five process devices of the photosensitive drum 2, the charging roller 3, the developing device 5, the cleaning device 7 and a non-volatile memory 101P into a unit which is detachably mountable to the main assembly. The T cartridge is a toner cartridge (PTY, PTM, PTM, PTK) which is prepared by integrally assembling the toner container 49 (developing container) in which the developer is accommodated and a non-volatile memory 101T in which fresh product information or the like is storable into a unit which is detachably mountable to the main assembly. The developer accommodated in the toner container 49 is supplied to the developing device 5. Each of the non-volatile memory 101P and the non-volatile memory 101T is capable of communicating with the control means portion 100 (CPU) via a contact (not shown) to the main assembly of the image forming apparatus 1.

Other constitutions are the same as those in Embodiment 1.

(Specific Control Method in Constitution in Embodiment 2)

In this embodiment, when the photosensitive drum remaining amount D described in [2. Specific control flow] in Embodiment 1 is 100% to 72%, the reverse rotation is performed by 5 mm and when the photosensitive drum remaining amount D is 71% to 0%, the reverse rotation is performed by 1 mm. In the case where the P cartridge and the T cartridge are independently detachably mountable, irrespective of the old and new cartridges, there is a possibility that a new (fresh) T cartridge is mounted. As in Embodiment 1, when the reverse rotation amount is made zero depending on the photosensitive drum remaining amount D, there is a possibility that the image blur occurs in the case where the new T cartridge is mounted. Therefore, in view of the exchange of the T cartridge, the reverse rotation operation is performed in order to suppress the image blur irrespective of the remaining amount D of the photosensitive member. However, when the reverse rotation amount is large, the abrasion non-uniformity occurs and therefore the reverse rotation amount is decreased during the lifetime of the cartridge so that the abrasion non-uniformity level is "○" in the range of 100% to 0% of the photosensitive drum remaining amount D. The reason why the reverse rotation amount is not decreased as the initial stage is that the residue, such as the fine powder toner or the external additive, having a small particle size is liable to be sent to the cleaning blade 7 in a large amount during a fresh state of the toner cartridge. In this embodiment, the T cartridge was replaced with the new cartridge at the time when the photosensitive drum remaining amount D is 71%.

A specific flow of the above control in this embodiment will be described with reference to FIG. 1.

(S41) The image forming operation is started. Simultaneously, measurement of each of the times $T_{(i)}$, $T_{(I)}$ and $T_{(aye)}$ (sec) during the image formation is started.

(S42) The image is printed (formed) on the basis of the image data.

(S43) Whether or not the conveyed transfer material 12 is a final transfer material (last paper) or not is checked. When the conveyed transfer material 12 is not the final transfer material 12, the operation is returned to S42.

(S44) The predicted value of the remaining amount D (%) of the photosensitive drum 2 is calculated.

(S45) The current remaining layer thickness E of the photosensitive layer stored in the non-volatile memory 101 is rewritten into the remaining layer thickness E' of the photosensitive layer after the calculation.

(S46) In the case where the remaining amount D (%) of the photosensitive drum 2 is 72% or more, the reverse rotation movement amount is 5 mm and in the case where the remaining amount (%) is less than 72%, the reverse rotation movement amount is 1 mm. At the time when the remaining amount D (%) was 71%, the T cartridge was replaced with the new cartridge.

(S47) The photosensitive drum stop control sequence is executed.

(S48) The photosensitive drum is completely stopped.

Comparative Embodiment 2

In this comparative embodiment, Comparative Embodiment 1 in Embodiment 1 was compared with Embodiment 2.

(Result of Study of Abrasion Non-Uniformity)

Figure 8:
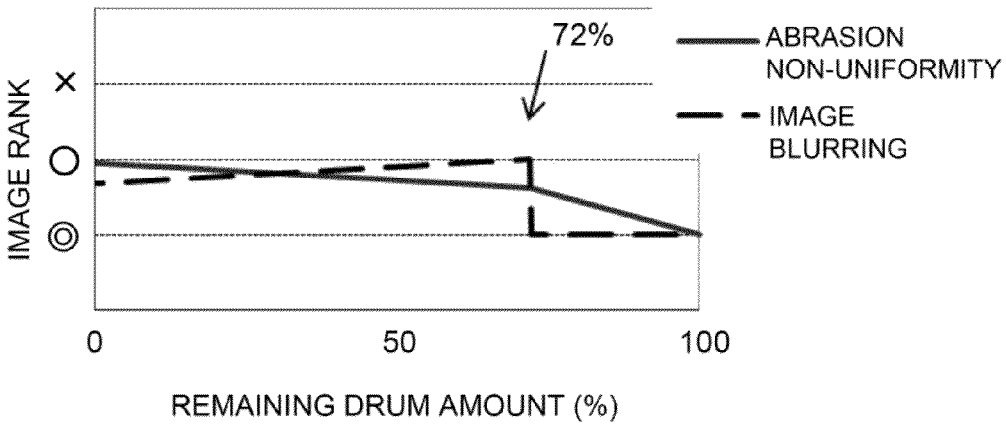
FIG. 8 is a graph showing relationships between the remaining amount (%) of the photosensitive drum and the abrasion non-uniformity and between the remaining amount (%) and the image blur in Embodiment 2.

FIG. 8 is progression of the abrasion non-uniformity and the image blur with respect to the remaining amount D of the photosensitive drum in Embodiment 2. However, when the photosensitive drum remaining amount D in the P cartridge was 71%, the T cartridge was replaced with the new cartridge.

In the figure, the ordinate represents an image rank, which was evaluated similarly as in Embodiment 1.

In FIG. 8, when the photosensitive drum remaining amount D is 100% to 72%, the abrasion non-uniformity level was from "◎" to between "◎" and "○" and was finally "○". Further, the image blur level was "◎" when the photosensitive drum remaining amount D was 100% to 72%, and was changed to between "◎" and "○" when the remaining amount D was below 72% and the reverse rotation of 1 mm and the replacement of the T cartridge with the new cartridge were performed.

The abrasion non-uniformity is worsened early since the abrasion amount is large when the reverse rotation amount is 5 mm. However, when the reverse rotation amount is made 1 mm in the photosensitive drum remaining amount D of exceeding 72%, the abrasion amount is decreased compared with the case of the reverse rotation amount of 5 mm, and therefore a degree of worsening of the abrasion non-uniformity becomes moderate. The image blur progresses at a good level with respect to the photosensitive drum remaining amount D by changing the reverse rotation amount from 5 mm to 1 mm at the time when the photosensitive drum remaining amount D is 72% and by replacing the T cartridge with the new cartridge. However, the residue such as the fine powder toner or the external additive is present and therefore the image blur is worsened but the reverse rotation is performed by 1 mm and the image blur level is "○" and then is improved.

The result of study in Comparative Embodiment 1 in FIG. 6 in this comparative embodiment is the same as that in Embodiment 1 and therefore will be omitted.

From the results described above, by using the specific control method in the constitution in Embodiment 2, the abrasion non-uniformity due to the reverse rotation is suppressed while suppressing the image blur, so that it is possible to provide a good image.

Incidentally, in Embodiments 1 and 2, the example in which the single threshold is provided is described but the control may also be finely effected by setting two thresholds. As the case where the two or more thresholds are set, e.g., the case where only the T cartridge is replaced with the new cartridge is assumed. In this case, on the basis of the fresh product information stored in the non-volatile memory 101T, the control means portion 100 (CPU) detects that the T cartridge is the new cartridge and then controls the reverse rotation. For example, in the case where the toner cartridge PT is replaced in the remaining amount D of 50%, the reverse rotation amount at an initial stage of 100% to 86% in remaining amount D is 5 mm and the reverse rotation amount in the remaining amount D is 85% or less is 1 mm. As an example, the case where the toner cartridge PT is replaced at certain timing, e.g., at timing when the remaining amount D of the photosensitive drum 2 is 50% will be described. In the case where the toner cartridge PT is detected as being the new cartridge by the non-volatile memory 101T and the control means portion 100 (CPU), the reverse rotation amount is 5 mm in the range of the remaining amount D of the photosensitive drum 2 from 50% to 36% and is 1 mm in the range of the remaining amount D from 35% to 0%. That is, in the case where the new toner cartridge PT is mounted, in a period in which the remaining amount D of the photosensitive drum 2 is decreased by 14% (from 50% to 36%), the threshold of the remaining amount D of the photosensitive drum 2 is newly set at 36% so as to increase the reverse rotation amount. Then, the fresh product information stored in the memory 101T of the toner cartridge PT is deleted. As a result, the abrasion non-uniformity due to the reverse rotation is suppressed while suppressing the image blur, so that the good image can be provided.

In other words, depending on the mounting of the new toner cartridge PT, the reverse rotation switching threshold is newly provided, so that the good image is provided.

Embodiment 3

In this embodiment, depending on the remaining amount D of the photosensitive drum 2, the number of rotations of the intermittent normal rotation performed after the stop of the photosensitive drum and the rotation amount of the reverse rotation were controlled. Other constitutions are the same as those in Embodiment 1.

(Specific Control Method in Constitution in Embodiment 3)

In this embodiment, the control of the normal rotation and the reverse rotation in the photosensitive drum stop control sequence is effected depending on the remaining amount D of the photosensitive drum 2. In Embodiment 3, in the range of the photosensitive drum remaining amount D from 100% to 55% described in [2. Specific control flow] in Embodiment 1, the intermittent normal rotation is performed 5 times as movement of 1 mm per 5 sec and the reverse rotation is performed as movement of 5 mm after a lapse of 5 sec from the stop of the intermittent normal rotation. In the range from 54% to 0%, the intermittent normal rotation is performed 10 times as movement of 1 mm per 5 sec and the reverse rotation is not performed. In the range from 100% to 55%, the residue, such as the fine powder toner or the external additive, having the small particle size remaining in the contact nip between the develop 2 and the cleaning blade 7 was dispersed to the outside of the contact nip by the intermittent normal rotation and the reverse rotation. On the other hand, in the range from 54% to 0%, the reverse rotation is not performed for the abrasion non-uniformity suppression. Therefore, for that purpose, the number of times of the intermittent normal rotation is increased to 10 times, so that the residue, such as the fine powder toner or the external additive, having the small particle size remaining in the contact nip between the photosensitive drum 2 and the cleaning blade 7 is dispersed to the outside of the contact nip. That is, in the range from 54% to 0%, the dispersion of the residue to the outside of the contact nip to be performed by the reverse rotation is carried out by increasing the number of times of the normal rotation. The dispersion of the residue to the outside of the contact nip is effective by the reverse rotation more than by the normal rotation. Further, by increasing the number of times of the normal rotation, there is a disadvantage that the stop control sequence is prolonged. However, in the case here there is a possibility of an occurrence of the abrasion non-uniformity by a decrease of the photosensitive drum remaining amount D, the reverse rotation is not performed and the number of times of the normal rotation is increased, so that the suppression of the occurrence of the abrasion non-uniformity and the suppression of the image blur are compatibly realized. As a result, in the range of the photosensitive drum remaining amount D between 100% and 0%, the image blur level and the abrasion non-uniformity level were "○".

Figure 9:
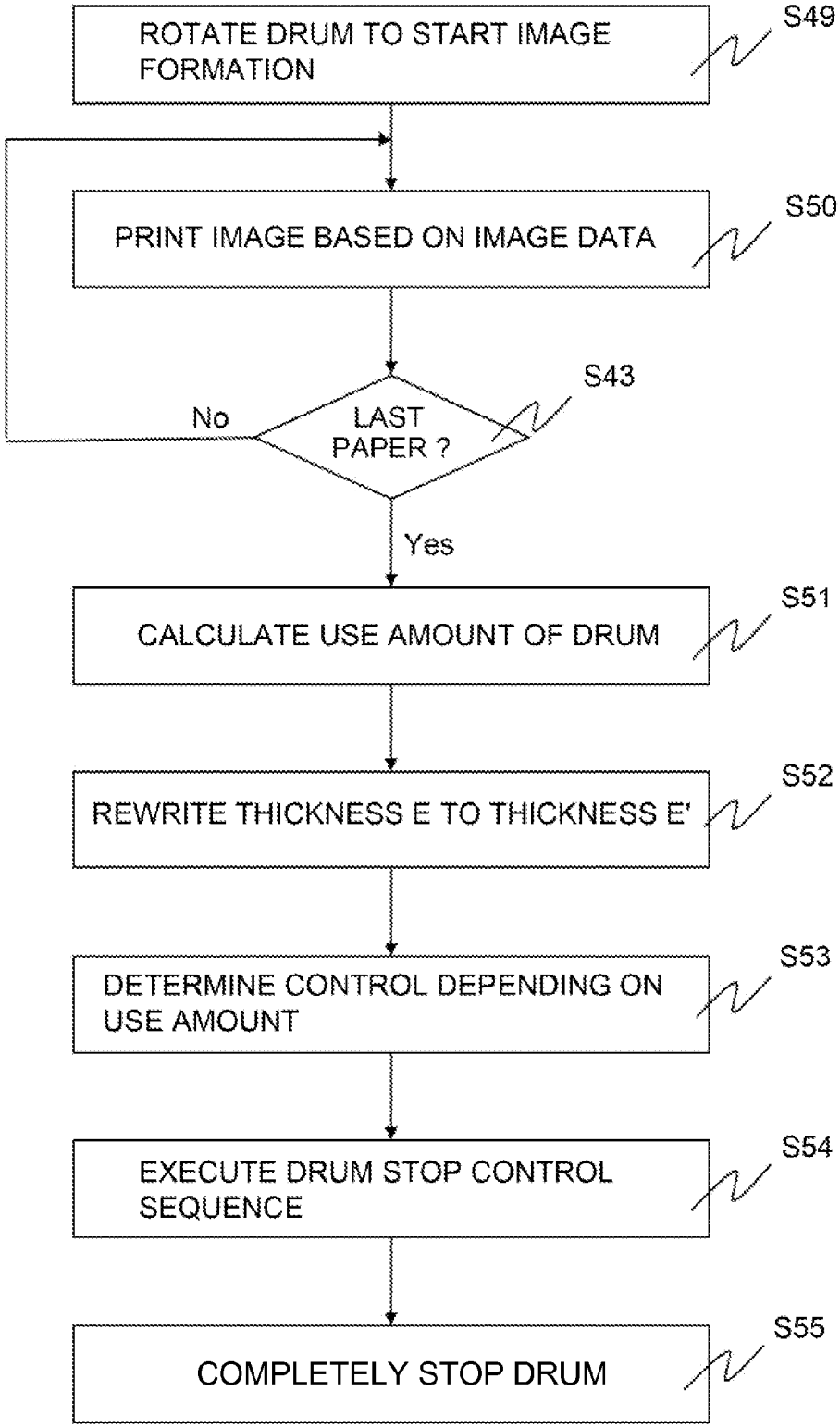
FIG. 9 is a flow chart of a photosensitive drum stop control sequence in Embodiment 3.

A specific flow of the above control in this embodiment will be described with reference to FIG. 9.

(S49) The image forming operation is started. Simultaneously, measurement of each of the times $T_{(i)}$, $T_{(I)}$ and $T_{(aye)}$ (sec) during the image formation is started.

(S50) The image is printed (formed) on the basis of the image data.

(S43) Whether or not the conveyed transfer material 12 is a final transfer material (last paper) or not is checked. When the conveyed transfer material 12 is not the final transfer material 12, the operation is returned to S50.

(S51) The predicted value of the remaining amount D (%) of the photosensitive drum 2 is calculated.

(S52) The current remaining layer thickness E of the photosensitive layer stored in the non-volatile memory 101 is rewritten into the remaining layer thickness E' of the photosensitive layer after the calculation.

(S53) In the case where the remaining amount D (%) of the photosensitive drum 2 is 55% or more, the intermittent normal rotation is performed 5 times, the reverse rotation movement amount is 5 mm, and in the case where the remaining amount (%) is less than 72%, the intermittent normal rotation is performed 10 times and the reverse rotation movement amount is not performed.

(S54) The photosensitive drum stop control sequence is executed.

(S55) The photosensitive drum is completely stopped.

Comparative Embodiment 3

In this comparative embodiment, the same constitution as that in Comparative Embodiment 1 in Embodiment 1 was employed.

(Result of Study of Abrasion Non-Uniformity)

Figure 10:
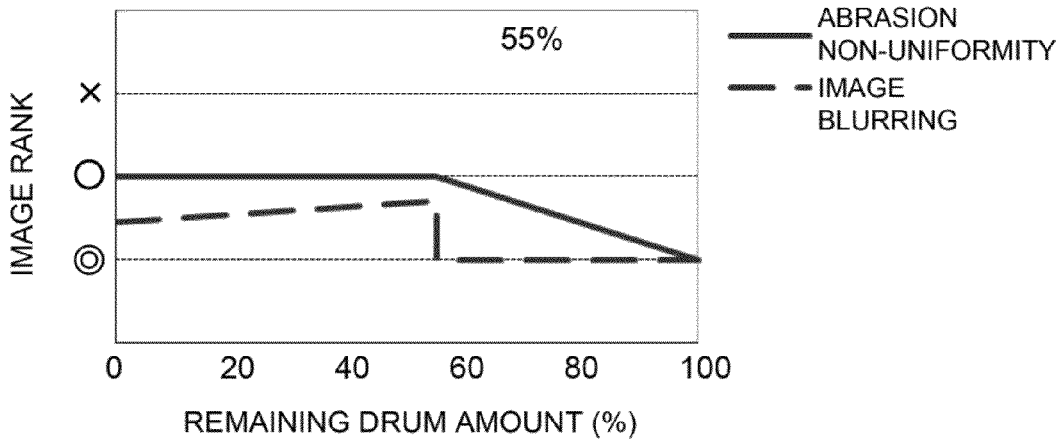
FIG. 10 is a graph showing relationships between the remaining amount (%) of the photosensitive drum and the abrasion non-uniformity and between the remaining amount (%) and the image blur in Embodiment 3.
Figure 11:
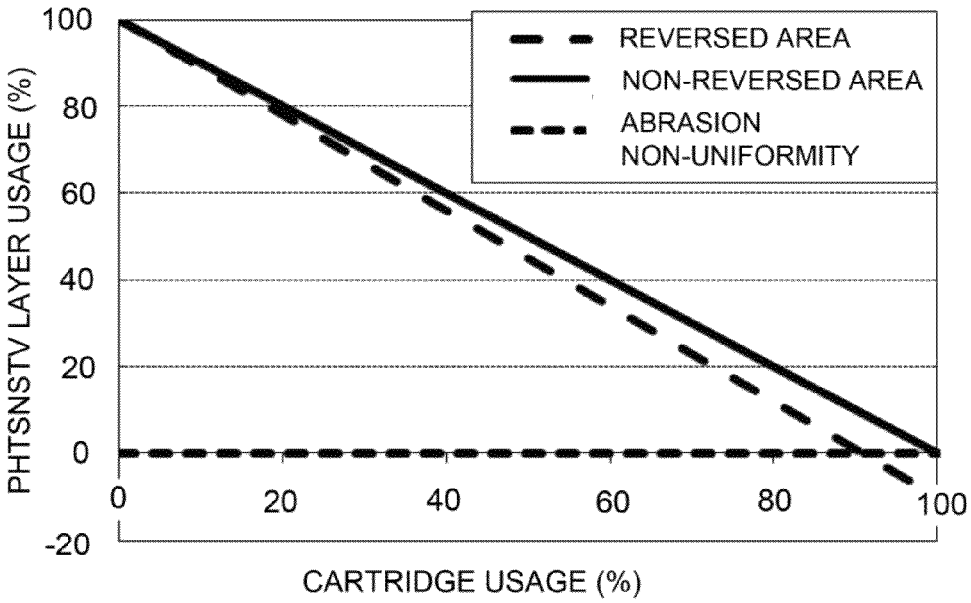
FIG. 11 is a graph showing a relationship between a cartridge usage and a photosensitive layer usage in an area in which reverse rotation is performed and in an area in which the reverse rotation is not performed.

FIG. 10 is progression of the abrasion non-uniformity and the image blur with respect to the remaining amount D of the photosensitive drum in Embodiment 3. In the figure, the ordinate represents an image rank, which was evaluated similarly as in Embodiment 1.

In FIG. 10, when the photosensitive drum remaining amount D is 100% to 55%, the abrasion non-uniformity level was between "◎" and "○". Further, the image blur level was "◎" throughout the range. Further, from the time when the reverse rotation was not performed, the image blur level was changed from "◎" to "○" and was improved in the remaining amount D toward 0%. The abrasion non-uniformity is worsened by performing the reverse rotation. The abrasion non-uniformity level is not changed in the range from 54% toward 0% since the reverse rotation was not performed. The image blur level is "◎" (from 100%) until 55% by performing the reverse rotation but when the reverse rotation is stopped, the image blur level is between "◎" and "○". The reason why the image blur is improved in the range from 54% to 0% is that the residue, such as the fine powder toner or the external additive, having the small particle size causing the image blur is generated in a large amount in the first half of the lifetime of the process cartridge and is decreased in the latter half of the lifetime. The fine powder toner is, in a general system such that the developer is supplied to the developing roller by the supplying roller and is regulated by the metal blade, regulated during the regulation with respect to a large particle size toner and thus is subjected to development selectively from the small particle size toner and therefore, the fine powder toner is used in the large amount in the first half of the lifetime and is decreased in the latter half of the lifetime. Further, the residue such as the external additive is present in the form of the external additive liberated at the initial stage or the external additive externally added to the toner in the first half of the lifetime of the process cartridge and is decreased in amount due to the deterioration of the toner in the latter half of the lifetime.

The result in Comparative Embodiment 3 is the same as that in Comparative Embodiment 1 described in Embodiment 1.

From the above, by using the constitution in this embodiment, the abrasion non-uniformity due to the reverse rotation is suppressed while suppressing the image blur, so that it is possible to provide a good image.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 004020/2011 and 286817/2011 filed Jan. 12, 2011 and Dec. 27, 2011, respectively, which are hereby incorporated by reference.

What is claimed is:

1. An image forming apparatus comprising:

an image bearing member for bearing a developer image;

driving means for rotationally driving said image bearing member;

a developing device for developing an electrostatic latent image on said image bearing member into the developer image;

a cleaning blade, slidably contacting said image bearing member which is rotated, for removing from the image bearing member a developer remaining on said image bearing member after transfer of the developer image;

control means capable of executing a stop operation of said image bearing member in which said image bearing member is, after being temporarily stopped at an end of an image forming operation, rotated in the same direction as that during the image forming operation and then is rotated in a direction opposite to that during the image forming operation; and predicting means for predicting a remaining usable lifetime of said image bearing member, wherein in the stop operation of said image bearing member after the remaining usable lifetime is below a threshold, said control means controls an amount of rotation in the direction opposite to that during the image forming operation so as to be smaller than the amount of rotation before the remaining usable lifetime is below the threshold.

2. An image forming apparatus according to claim 1, wherein said predicting means calculates the remaining usable lifetime on the basis of use information of said image bearing member including a rotation time of said image bearing member.

3. An image forming apparatus according to claim 1, wherein in the stop operation of said image bearing member after the remaining usable lifetime is below the threshold, the amount of rotation in the direction opposite to that during the image forming operation is zero.

4. An image forming apparatus according to claim 1, wherein in the stop operation, the rotation in the same direction as that during the image forming operation is intermittently performed plural times.

5. An image forming apparatus according to claim 4, wherein in the stop operation of said image bearing member after the remaining usable lifetime is below the threshold, the amount of rotation in the direction opposite to that during the image forming operation is zero and the rotation in the same direction as that during the image forming operation is performed so that the number of times when the rotation is intermittently performed is larger than that before the remaining usable lifetime is below the threshold.

6. An image forming apparatus according to claim 1, wherein in the stop operation, the amount of rotation in the direction opposite to that during the image forming operation is larger than the amount of rotation in the same direction as that during the image forming operation and is an amount in which a contact portion of said image bearing member with said cleaning blade does not reach a transfer position where the developer image is transferred onto a recording material.

7. An image forming apparatus according to claim 1, further comprising:

a process cartridge, including at least said image bearing member, detachably mountable to a main assembly of said image forming apparatus; and a toner cartridge, including at least a developing container for accommodating the developer to be supplied to a developing device, detachably mountable to the main assembly, wherein said toner cartridge includes a memory capable of storing fresh product information, and wherein said control means newly provides the threshold to effect the control when said toner cartridge is detected as being a fresh toner cartridge from the fresh product information stored in said memory.

8. An image forming apparatus according to claim 1, wherein said image bearing member is provided in a plurality of image bearing member portions, and said image forming apparatus further comprising driving means for each of the image bearing member portions, and the stop operation is independently performed for each of the image bearing member portions.

* * * * *